US008299697B2

(12) United States Patent
Kong

(10) Patent No.: US 8,299,697 B2
(45) Date of Patent: Oct. 30, 2012

(54) HIGH PERFORMANCE FLUORESCENT LAMP

(76) Inventor: Qin Kong, San Diego, CA (US)

( * ) Notice: Subject to any disclaimer, the term of this patent is extended or adjusted under 35 U.S.C. 154(b) by 44 days.

(21) Appl. No.: 12/925,188

(22) Filed: Oct. 15, 2010

(65) Prior Publication Data

US 2012/0091880 A1 Apr. 19, 2012

(51) Int. Cl.
*H01J 1/62* (2006.01)
*H01J 63/04* (2006.01)

(52) U.S. Cl. ..... 313/490; 313/493; 313/634

(58) Field of Classification Search ..... 313/484–486, 313/488, 490, 493, 567, 623, 624, 634–636, 313/637, 641–643, 318.01
See application file for complete search history.

(56) References Cited

U.S. PATENT DOCUMENTS

| | | | | |
|---|---|---|---|---|
| 5,336,968 | A * | 8/1994 | Strok et al. | 313/571 |
| 6,337,539 | B1 * | 1/2002 | Yorifuji et al. | 315/56 |
| 2006/0164000 | A1 * | 7/2006 | Nishimura et al. | 313/489 |
| 2009/0160342 | A1 * | 6/2009 | Iida | 313/643 |

* cited by examiner

*Primary Examiner* — Anh Mai
*Assistant Examiner* — Kevin Quarterman
(74) *Attorney, Agent, or Firm* — Raymond Y. Chan; David and Raymond Patent Firm

(57) ABSTRACT

A high performance fluorescent lamp includes an air-vacuum glass envelope having sealed ends, and a light cavity filled with inert gas and coated with a phosphor layer at an inner wall of said light cavity; two electrodes sealed at each of the sealed ends of the glass envelope; and a narrowing channel integrally formed at one of the sealed ends of the glass envelope at a location communicating with the light cavity of the glass envelope. Therefore, the amalgam is contained within the narrowing channel at a position forming a preset distance between one of the electrodes sealed at the corresponding sealed end and the amalgam.

23 Claims, 10 Drawing Sheets

HIGH PERFORMANCE FLUORESCENT LAMP

BACKGROUND OF THE PRESENT INVENTION

1. Field of Invention

The present invention relates to a fluorescent lamp, and more particularly to a high performance fluorescent lamp which has low manufacturing cost and simple structural configuration for manufacture.

2. Description of Related Arts

The fluorescent lamp is basically a low pressure mercury discharge lamp. A conventional fluorescent generally comprises an air-tight tubular casing coated with fluorescent powder or phosphors powder at an inner wall thereof and filled with lower pressure mercury vapor and inert gases, and two electrodes at two ends of the tubular casing. When the electrodes are connected to a power source and electrified, the voltage between the two electrodes will break down the inert gases and the electron can go through between the electrodes. The mercury atoms are excited by the electrons for emitting Ultraviolet (UV) light. Then, the coating of fluorescent powder or phosphors powder will convert the UV light to visible light. Accordingly, the performance of the fluorescent lamp is controlled by the mercury vapor pressure, inert gases, and the phosphor powder coating.

In the traditional fluorescent lamp, pure mercury is filled into the tubular casing of the lamp. When the lamp operates at 25° ambient temperature, the lamp has the highest light output. The mercury vapor pressure is able 0.8 Pa. When the ambient temperature increased, the mercury vapor pressure is correspondingly increased and the self-absorption in the vapor reduces the yield of UV and visible light. Therefore, when the mercury vapor pressure is increased, the light output will be reduced. In order to improve the operation temperature of the fluorescent lamp, the mercury vapor pressure should be regulated. A common way to regulate the mercury vapor pressure is using amalgam. Accordingly, amalgam is mercury mixed with various alloys, wherein different mixtures of the amalgam will have different operation temperature ranges. Amalgam, to be used in the lamp for higher operation temperature is expensive and needed an auxiliary amalgam. A fluorescent lamp with low temperature amalgam can operate at 35° C. ambient temperature.

U.S. Pat. No. 4,972,118 disclosed an improved fluorescent lamp with amalgam adapted to be operated at 45° C. to 55° C. ambient temperature, wherein the amalgam has a main amalgam and an auxiliary amalgam. The main amalgam is located in a special container. An expensive high temperature amalgam has to be used if the lamp needs to be operated at higher ambient temperature. Therefore, such lamp is extremely expensive and is difficult to manufacture.

The nature light source on earth is sunlight. Sunlight is considered as natural light to be comfortably visible to the human eye normally. Human being can see different colors based on wavelength of sunlight within the visible spectrum. The range of wavelengths that human being can perceive is known as visible light. In other words, to generate a light similar to sunlight spectrum is an "ideal light". Sunlight spectrum is from UV light to IR (infrared) light. However, human being can only see portion of sunlight. According to CIE chromaticity or color space, the wavelength of light that human eye can see is from 380 nm to 700 nm. Therefore, the spectrum of the "ideal light" should be from 380 nm to 700 nm.

All fluorescent lamps use fluorescent powder or phosphors powder to convert ultraviolet light to visible light. U.S. Pat. No. 4,199,707 disclosed a basic light spectrum of the fluorescent lamp, wherein in the light spectrum, there is almost no light wavelength from 380 nm to 420 nm.

According to Ohm's Law, V=R*I, it states that doubling the voltage will double the current. It is called "Positive Voltage-Current Characteristic". The incandescent lamp has the "Positive Voltage-Current Characteristic". For fluorescent lamp, the lamp impedance R is not a constant number. The lamp impedance R will be increased when the lamp current is reduced. It is called "Negative Voltage-Current Characteristic". It means that doubling the current will cause less doubled the voltage. It will generate more heat and lower the efficiency of the lamp.

SUMMARY OF THE PRESENT INVENTION

The invention is advantageous in that it provides a high performance fluorescent lamp which is easy and low cost for manufacture to meet the need of the lamp in responsive to the operation temperature and wattage. In other words, the lamp of the present invention has wide operation temperature range with the same amalgam.

Another advantage of the invention is to provide a high performance fluorescent lamp, wherein the lamp can be operated under different ambient temperature or different wattage of the lamp with the same type of amalgam by controlling a distance between the amalgam and the respective filament of the electrode. In other words, there are different techniques to control the temperature at the location of the amalgam, wherein such techniques can be used individually or combined to achieve the right temperature at the amalgam location.

Another advantage of the invention is to provide a high performance fluorescent lamp, wherein the amalgam is retained and blocked within the tail pipe by the narrow opening thereof to retain a fixed position and to prevent any unwanted movement of the amalgam disposed in the tail pipe.

Another advantage of the invention is to provide a high performance fluorescent lamp, which has adjusted Voltage-Current characteristic and improved light efficient.

Another advantage of the invention is to provide a high performance fluorescent lamp, which can produce an ideal wider range of wavelength of visible light similar to sunlight spectrum.

Another advantage of the invention is to provide a high performance fluorescent lamp, wherein the Xenon gas of the inert gas is further added for increasing the lamp voltage, so as to enhance the efficiency of the fluorescent lamp.

Additional advantages and features of the invention will become apparent from the description which follows, and may be realized by means of the instrumentalities and combinations particular point out in the appended claims.

According to the present invention, the foregoing and other objects and advantages are attained by a high performance fluorescent lamp, which comprises:

an air-tight glass envelope having sealed ends and a light cavity filled with inert gas and coated with a phosphor power at an inner wall of the air-tight glass envelop; and two electrodes each having a filament being provided at the two sealed end of the glass envelope respectively;

wherein a channel is integrally formed at one of the sealed ends of the glass envelope at a location communicating with the light cavity of the glass envelope, wherein an amalgam is contained within the channel at a position forming a preset distance between one of the filaments sealed at the corresponding sealed end and the amalgam.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
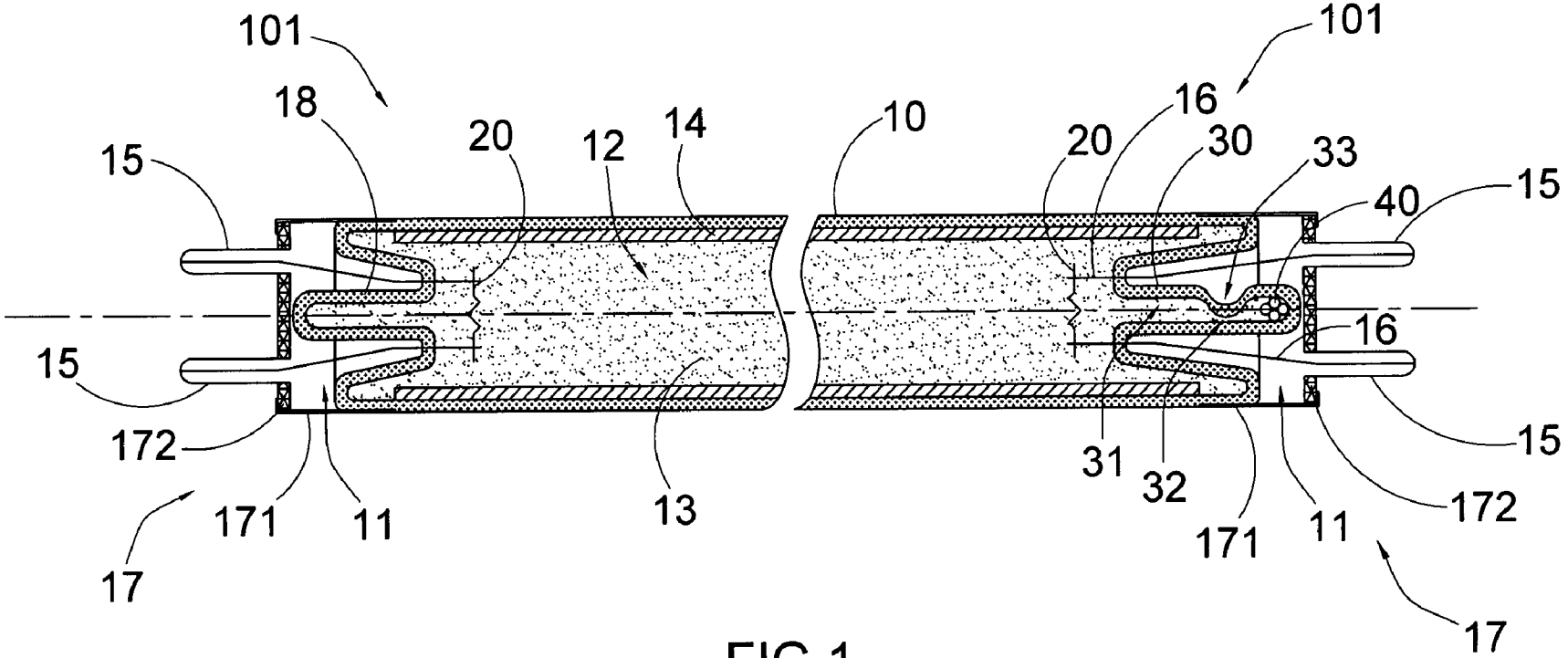
FIG. 1 is a perspective view of the fluorescent lamp according to a preferred embodiment of the present invention.

Referring to FIGS. 1 to 4 of the drawings, a high performance fluorescent lamp according to a preferred embodiment of the present invention is illustrated, wherein said fluorescent lamp comprises an air-tight glass envelope 10 having two sealed ends 11 and a light cavity 12 formed between the sealed ends 11 and two electrodes 101 provided at the two sealed ends 11 of the glass envelope 10 within the light cavity 12. Each electrode 101 includes a filament 20 and two or more contact terminals 15, and support wires 16 which support the filament 20 in position and extended from the filament 20 to the contact terminals 15 respectively for power supply.

Accordingly, the light cavity 12 of the glass envelope 10 is filled with inert gas 13 and coated with a phosphor powder 14 at an inner wall of the light cavity 12 of the air-tight glass envelope 10. A low pressure metal vapor, preferably Mercury vapor, is also filled within the light cavity 12 of the glass envelope 10 to mix with the inert gas 13.

As mentioned above, the filaments 20 are preferably sealed at the two sealed ends 11 of the air-tight glass envelope 10 respectively, wherein when the two filaments 20 are connected to a power source through the two support wires 16 and the contact terminals 15, the voltage between the two filaments 20 is breaking down the intermolecular bonding of the inert gas 13 to form electron current between the two filaments 20. The mercury atoms are excited by the electrons of the inert gas 13 to release the energy via emitting ultraviolet light. Thus, the phosphor powder 14 coated at the inner wall of the light cavity 12 of the glass envelope 10 is absorbing the UV light to convert it into visible light emitting out of the light cavity 12 for illuminating the environment or other purposes.

One of the electrodes 101 of the fluorescent lamp further comprises a tubular tail pipe 30 and an amalgam 40 retained in the tubular tail pipe 30 in position.

According to the preferred embodiment, the tubular tail pipe 30 is integrally formed at the respective sealed end 11 of the glass envelope 10. As shown in FIG. 1, the tail pipe 30 is indently and integrally formed at the respective sealed end 11 of the glass envelope 10 that the circumferential wall of the tail pipe 30 is integrally extended from the circumferential wall of the glass envelope 10.

The tail pipe 30 has a diameter smaller than that of the glass envelope 10, wherein the tail pipe 30 is coaxially extended from the respective sealed end 11 of the glass envelope 10. The tail pipe 30 has a channel 31 defined therein and communicated with the light cavity 12, and a narrow opening 32 provided at a predetermined position along the channel 31 wherein the narrow opening 32 has a diameter narrower than that of the channel 31. It is worth mentioning that the narrow opening 32 is able to be indentedly formed by a dent on the tail pipe 30.

Accordingly, the channel 31, which is an elongated tube coaxially aligned with the light cavity 12, has a closed end formed at the distal end of the tail pipe 30 and an opened end adjacent the filament 20.

The other electrode 101 has an exhaust pipe 18 provided at the other sealed end 11 of the glass envelope 10. It is worth mentioning that the tail pipe 30 can also used as the exhaust pipe such that the exhaust pipe can be omitted.

The amalgam 40 is contained within the channel 31, a position between the narrow opening 32 and the distal end of the tail pipe 30, and blocked by the narrow opening 32 to retain a predetermined distance between the respective filament 20 and the amalgam 40, such that by configuring and controlling the distance between the respective filament 20 and the amalgam 40, the fluorescent lamp is adapted to be operated under various ambient temperatures or various wattages without substitution of the amalgam.

In other words, in order to enable the fluorescent lamp of the present invention being applied to a relatively wider range of operating temperatures, the narrow opening 32 is integrally formed at one of the sealed ends 11 of the glass envelope 10 at a location communicating with the light cavity 12 and containing the amalgam 40 therewithin. Therefore, the amalgam 40 is able to be positioned at a predetermined location to form a preset distance between the amalgam 40 and the corresponding filament 20.

It is worth to mention that the fluorescent lamp of the present invention is able to operate under variety of ambient temperatures by means of selectively adjusting the preset distance through making the narrow opening 32 at different position, wherein there are variety of ways for positioning the amalgam 40 by means of the narrow opening 32. Therefore, different channels 31 having narrow openings at different positions can retain the amalgam 40 at a predetermined location to preset the distance between the respective filament 20 and the amalgam 40 so as to form variety of fluorescent lamps for being operated under variety of operating temperatures. Accordingly, it is appreciated that without using different kinds of amalgam 40, such as using more expensive amalgam, one can still operate the fluorescent lamp under higher operating temperature while the manufacturing cost and process can remain low and simple.

According to the preferred embodiment, the tail pipe 30 is preferred to provide a dent portion 33 formed thereat to form the narrow opening 32 such that the amalgam 40 is contained at a predetermined distance between the dent portion 33 and a distal end of the tail pipe 30.

In other words, in order to effectively position the amalgam 40 at a predetermined location, at least one dent portion 33 is integrally and inwardly formed at the tail pipe 30, in such a manner that the amalgam 40 is contained at a distal end portion of the channel 31 and being blocked therein by means of the dent portion 33.

Figure 2A:
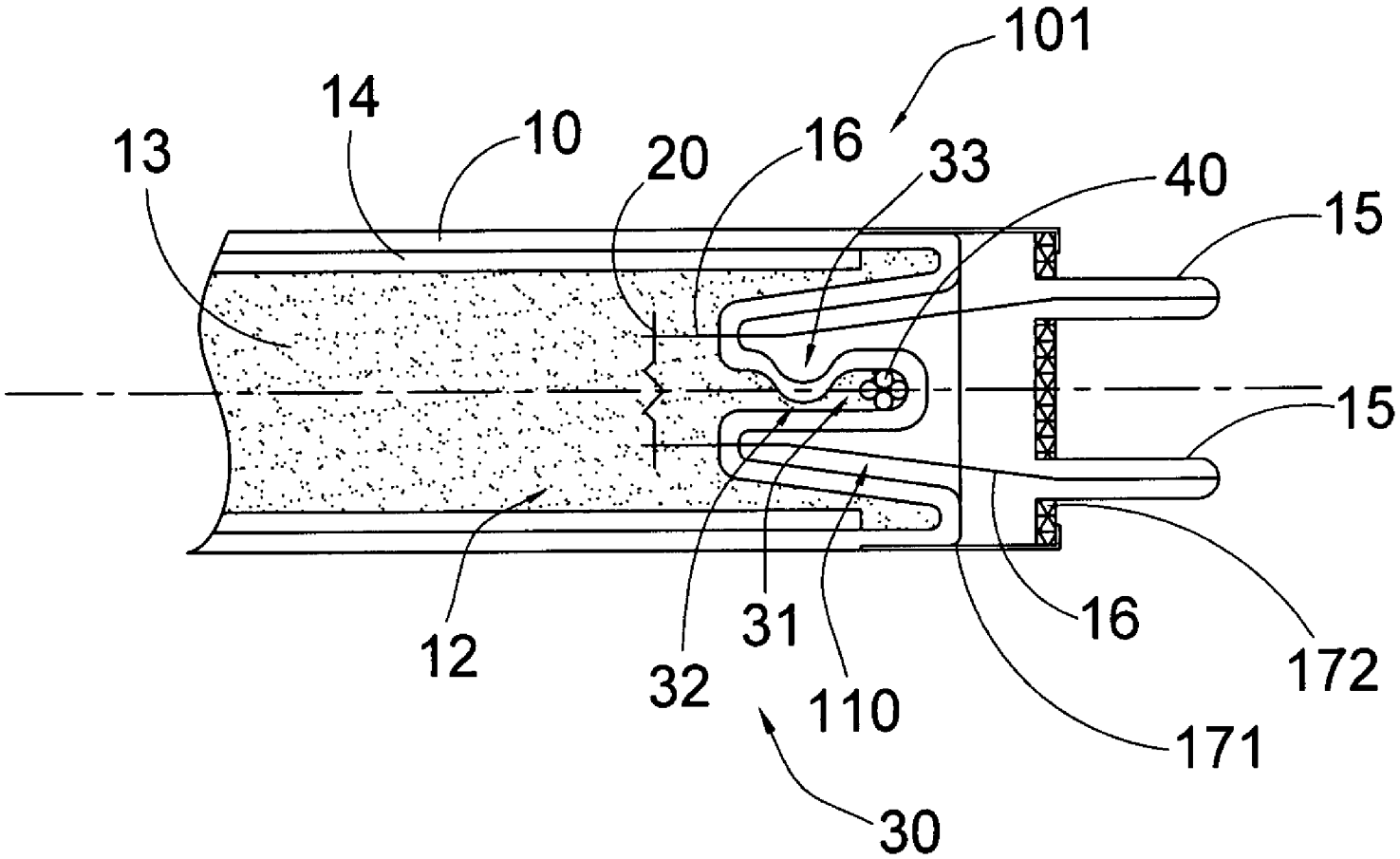
FIG. 2A illustrates a first alternative mode of the tail pipe of the fluorescent lamp according to the above preferred embodiment of the present invention, illustrating the narrowing channel having a shorter length.

As shown in FIG. 1 and FIG. 2A, the preset distance between the corresponding filament 20 and the amalgam 40 is able to be changed by making different length of the channel 31, i.e. the length of the tail pipe 30 via the narrow opening 32 thereof. It is worth mentioning that the amalgam 40 is received in the tail pipe 30 during a formation of the tail pipe 30 with respect to the glass envelope 10 to retain the amalgam 40 at a fixed position.

In the FIG. 1, the preset distance is relatively longer when the channel 31 has relatively longer length. In the FIG. 2A, the length of the channel 31 is shorter than the length thereof in FIG. 1, so that the amalgam 40 contained within the channel 31 and retained at the distal end portion thereof while the dent portion 33 is formed at a shorter distance from the corresponding filament 20. It is appreciated that through making different length of the channel 31, it is able to change the preset distance during the formation of the tail pipe 30, so as to make variety of fluorescent lamps for being operated under different ambient temperatures.

In other words, by making the channel 31 with different lengths and altering the positions of the dent portion 33, it is able to manufacture fluorescent lamp with variety of preset distances between the filament 20 and the amalgam 40 for being operated under variety ambient temperatures without changing the material or composition of the amalgam 40. It is worth to mention that changing the preset distance via making variety of channel 31 is able to manufacture the fluorescent lamp for being applied to different ambient temperature or operating temperature, so that without changing the composition of the amalgam 40 or using more expensive amalgam, the fluorescent lamp is able to be operated under wider temperature range and thus minimizing the manufacturing cost.

Furthermore, the tail pipe 30 is coaxially and inwardly extended at the respective sealed end 11 of the glass envelope 10 to form an indented cavity 110 at the sealed end 11 of the glass envelope 10 to encircle with the tail pipe 30.

The narrow opening 32 is formed within the indented cavity 110 of the glass envelope 10. In particularly, the distal end of the tail pipe 30 is extended out of the indented cavity 110 such that the length of the tail pipe 30 is longer than a depth of the indented cavity 110, as shown in FIG. 1. It is appreciated that the distal end of the tail pipe 30 is extended within the indented cavity 110, such that the length of the tail pipe 30 is shorter than a depth of the indented cavity 110, as shown in FIG. 2A. In other words, the length of the tail pipe 30 can be selectively adjusted to retain the amalgam 40 at the predetermined position during the formation of the tail pipe 30.

Figure 2B:
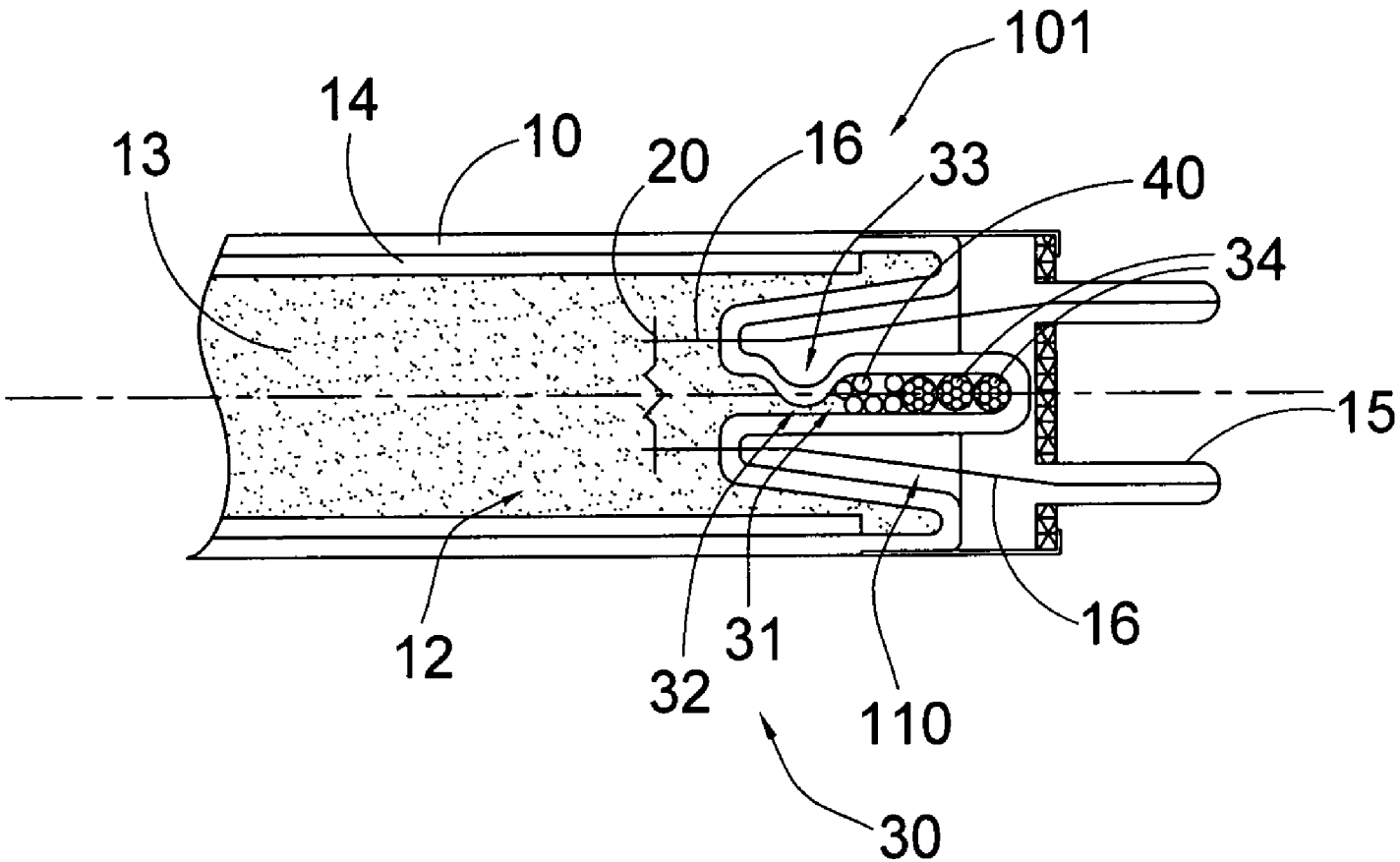
FIG. 2B illustrates a second alternative mode of the tail pipe of the fluorescent lamp according to the above preferred embodiment of the present invention, illustrating the amalgam being positioned via the glass beats.
Figure 2C:
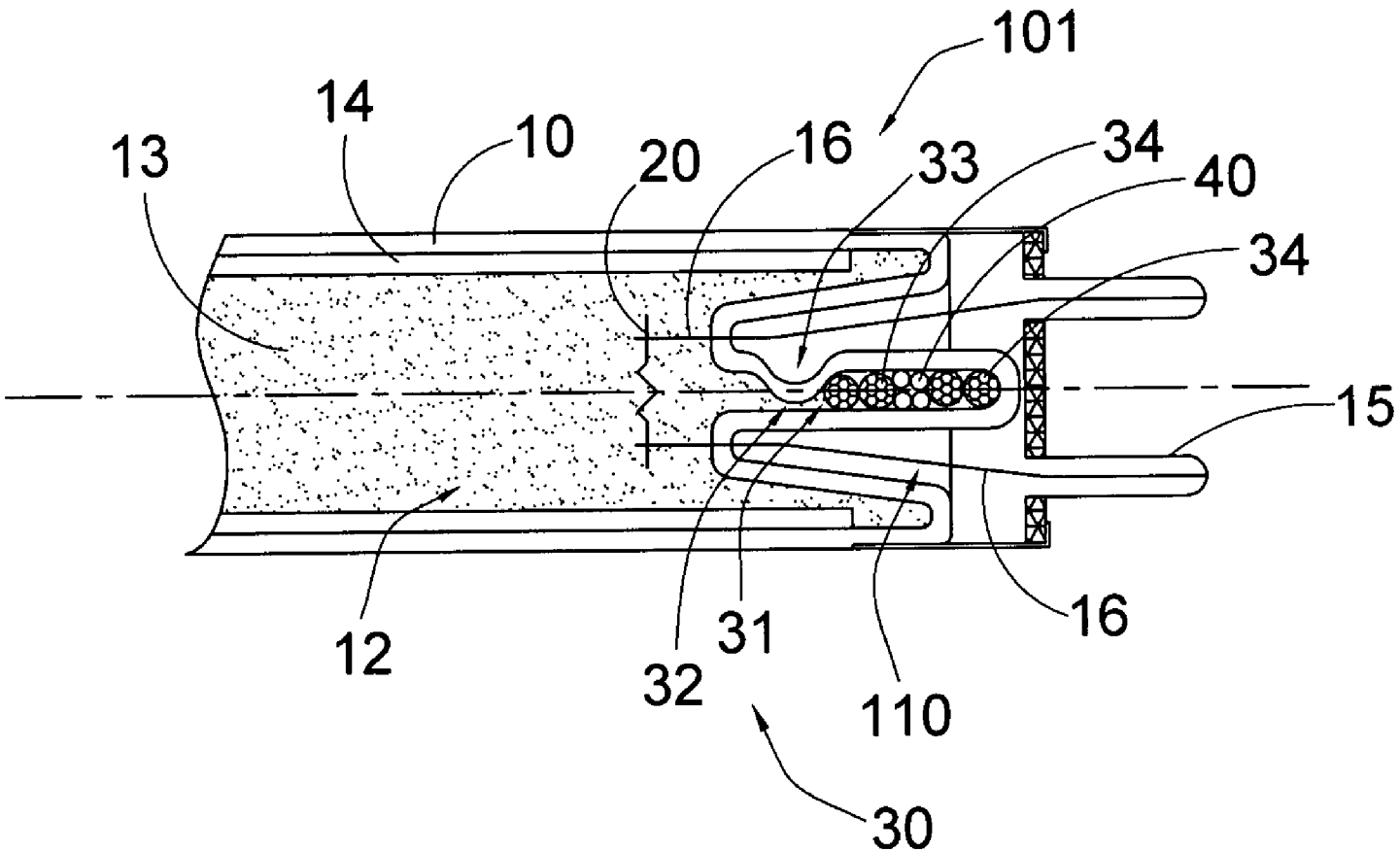
FIG. 2C illustrates a third alternative mode of the tail pipe of the fluorescent lamp according to the above preferred embodiment of the present invention, illustrating the amalgam being positioned and sandwiched between the glass beats.
Figure 2D:
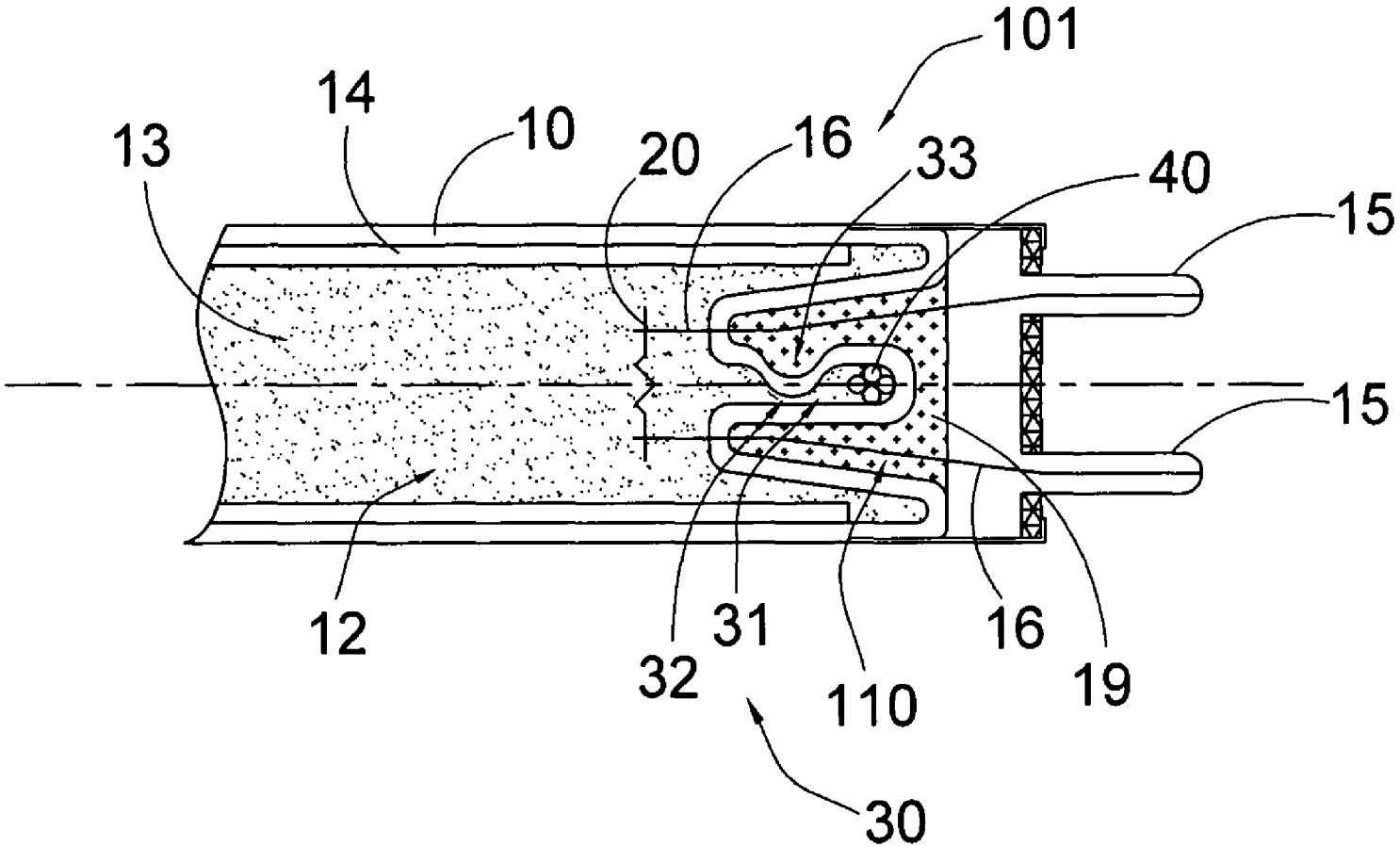
FIG. 2D illustrates a fourth alternative mode of the tail pipe of the fluorescent lamp according to the above preferred embodiment of the present invention, illustrating the indented cavity filled with insulation material.

In a cool environment, in order to keep the temperature of the amalgam 116 and prevent a cold area within the channel 31, which may condense the mercury vapor within the light cavity 12, the high performance fluorescent lamp further comprises an insulation material 19 disposed within the indented cavity 110 so as to keep the channel 31 and the light cavity 12 warm, as shown in FIG. 2D. The insulation material 19, for example, can be silicon rubber or any other insulating material.

FIGS. 2B and 2C illustrate an alternative mode to retain the amalgam 40 at the fixed position. Accordingly, the tail pipe 30 further comprises one or more glass beads 34 disposed within the channel 31 to further precisely retain the amalgam 40 at a preset position. Accordingly, the glass beads 34 are able to position the amalgam 40 located within the channel 31, so as to selectively fix the preset distance between the amalgam 40 and the corresponding filament 20 without making the different length of the channel 31.

In other words, the glass beads 34 are able to position the amalgam 40 at any location within the channel 31. In the FIG. 2B, the amalgam 40 is located within the channel 31 at a position between the narrow opening 32 and the glass beads 34. In other words, the glass beads 34 are provided at the free end of the channel 31, as one example. Therefore, the amalgam 40 is positioned between the dent portion 33 and the glass beads 34, and is located closer to the filament 20, so as to shorten the preset distance therebetween. Therefore, the fluorescent lamp is able to be operated under a lower ambient temperature.

As shown in FIG. 2C, the amalgam 40 is located within the channel 31 at a position between the glass beads 34. In other words, some of glass beads 34 are provided at the free end of the channel 31, while some of the glass beads 34 are provided closed to the narrow opening 32 of the tail pipe 30. Therefore, the amalgam 40 is located between the two groups of the glass beads 34 to further refine the position of the amalgam 40. It is worth mentioning that the number of each group of glass beads 34 can be selectively adjusted to retain the amalgam 40 at the fixed position precisely.

It is worth mentioning that the channel 31 in FIGS. 2B and 2C has the same length. Comparing to the configuration in FIG. 1, the dent portion 33 in FIGS. 2B and 2C is located at a position closer to the filament 20. The glass beads 34 are filled of the channel 31 for positioning the amalgam 40 at the predetermined location. By changing position and/or the amount of the glass beads 34, the position of the amalgam 40 is restructured to form different preset distance for different applications. Therefore, there is almost no extra manufacturing cost for making the fluorescent lamp in order to be operated under different ambient temperatures.

The contact terminals 15 provided at each sealed end 11 of the glass envelope 10 of the fluorescent are electrically connecting with the filament 20 through the support wires 16, so that when a power source is electrically connected to the contact terminals 15, the power therefrom is supplying to the filaments 20 for generating the UV light via the mercury in the light cavity 12.

In the preferred embodiment, to control a length of the portions of the two support wires 16, provided at each of the sealed ends 11 of the glass envelope 10 for electrically contacting with the corresponding filament 20, extended between the inner end of the tail pipe 30 and the respective filament 20 substantially controls a distance between the amalgam 40 and the filament 20. As described above, the support wires 16 are provided for electrically connecting the contact terminals 15 with the respective filament 20, wherein the end portions of the support wires 16 are enclosed within the contact terminals 15 respectively such that the contact terminals 15 are able to electrically connect with the filament 20.

Figure 2E:
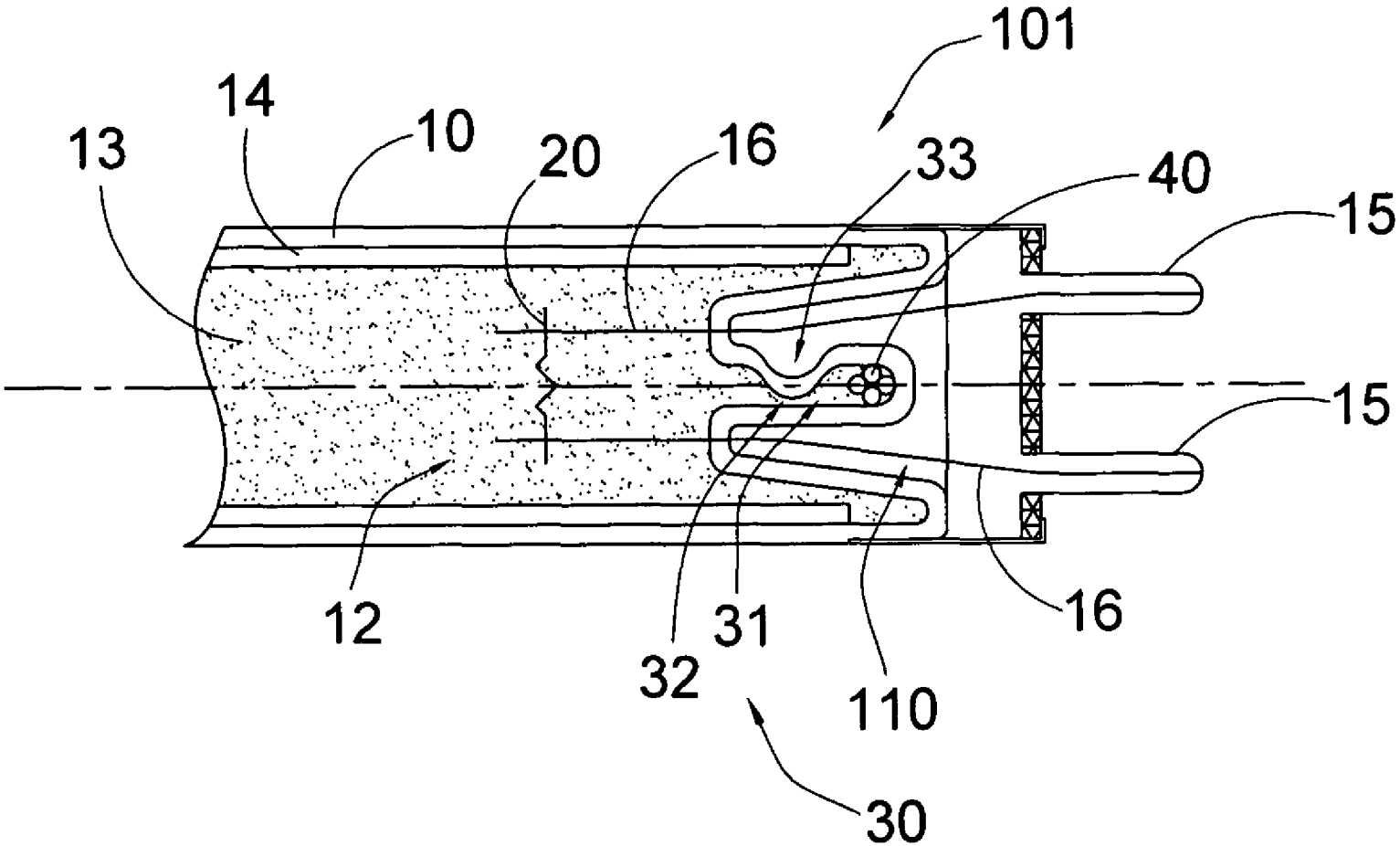
FIG. 2E illustrates a fifth alternative mode of the tail pipe of the fluorescent lamp according to the above preferred embodiment of the present invention, illustrating the filament extended to adjust the distance between the electrode and the amalgam.

As shown in FIG. 2E, the preset distance between the amalgam 40 and the corresponding filament 20 can also be changed by providing a relatively longer or shorter length of the portion of the support wires 16 extended from the inner end of the tail pipe 30 to the corresponding filament 20, so that the preset distance between the amalgam 40 and the filament 20 is further extended or reduced accordingly. Therefore, by making different length of the filament support 16, the preset distance between the filament 20 and the amalgam 40 can also be adjusted to a desired distance in order to operate the fluorescent lamp under variety ambient temperatures. For example, when the support wires 16 are being extended to increase the preset distance between the amalgam 40 and the corresponding filament 20, the temperature at the location of the amalgam 40 is lower that enables fluorescent lamp to be worked normally in an environment with a higher temperature.

Figure 2F:
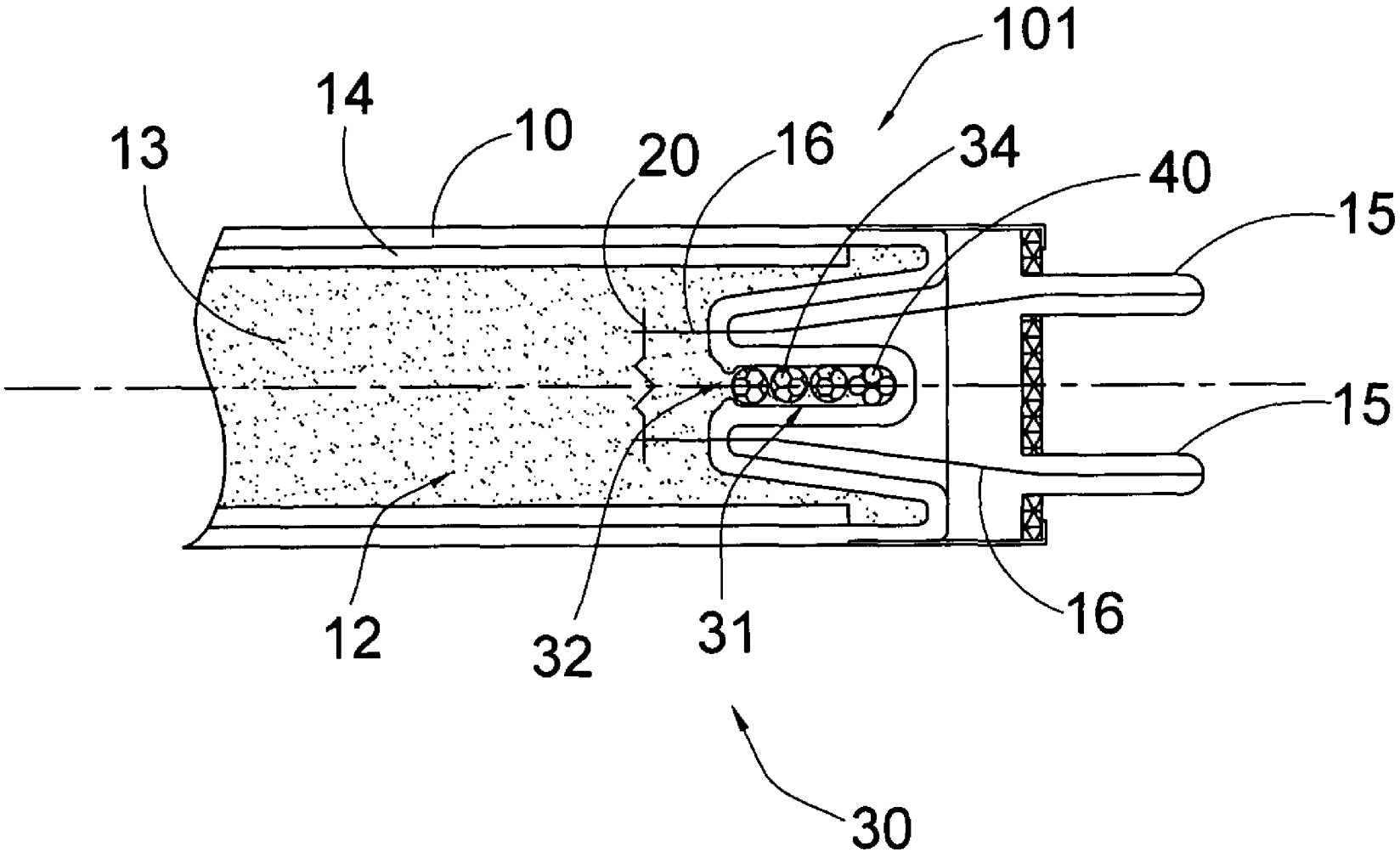
FIG. 2F illustrates a sixth alternative mode of the tail pipe of the fluorescent lamp according to the above preferred embodiment of the present invention, illustrating the amalgam being positioned and blocked via the glass beats without the dent.

Referring to FIG. 2F, an alternative mode of the tail pipe 30 is illustrated, wherein there is no dent portion 33 made thereat. As shown in FIG. 2F, the inner end portion of the tail pipe 30 forms the narrow opening 32 due to the glass joint process so as to retain one or more glass beads 34 fitting in the channel 31 and thus retain the amalgam 40 at a fixed position.

Accordingly, each of the glass beads 34 is slightly larger than the opening 32 such that when the glass beads 34 fit in the channel 31 during the formation of the tail pipe 30, the amalgam 40 is blocked by the glass beads 34 to limit a movement of the amalgam 40 within the channel 31. It is worth mentioning that the amalgam 40 can be selectively retained at the fixed position within the channel 31 by the number and preconfiguration of the glass beads 34 therewith.

The fluorescent lamp may further comprise a sealing base 17 provided at the sealed end 11 of the glass envelope 10, wherein the sealing base 17 encloses the indented cavity 110 and holds the contact terminals 15 in position. The sealing base 17 may further comprise a surrounding cover 171 encircling an outer peripheral surface of the glass envelope 10 adjacent to the sealed end 11 thereof and to form an end opening, and an end cover 172 engaging with the surrounding cover 171 to seal the end opening thereof, such that the indented cavity 110 is able to be enclosed within the surrounding cover 171 and the end cover 172 of the sealing base 17. The surrounding cover 171 can be made of aluminum or plastic material. The end cover 172 is preferably made of insulation material to be used as an insulator.

Figure 5:
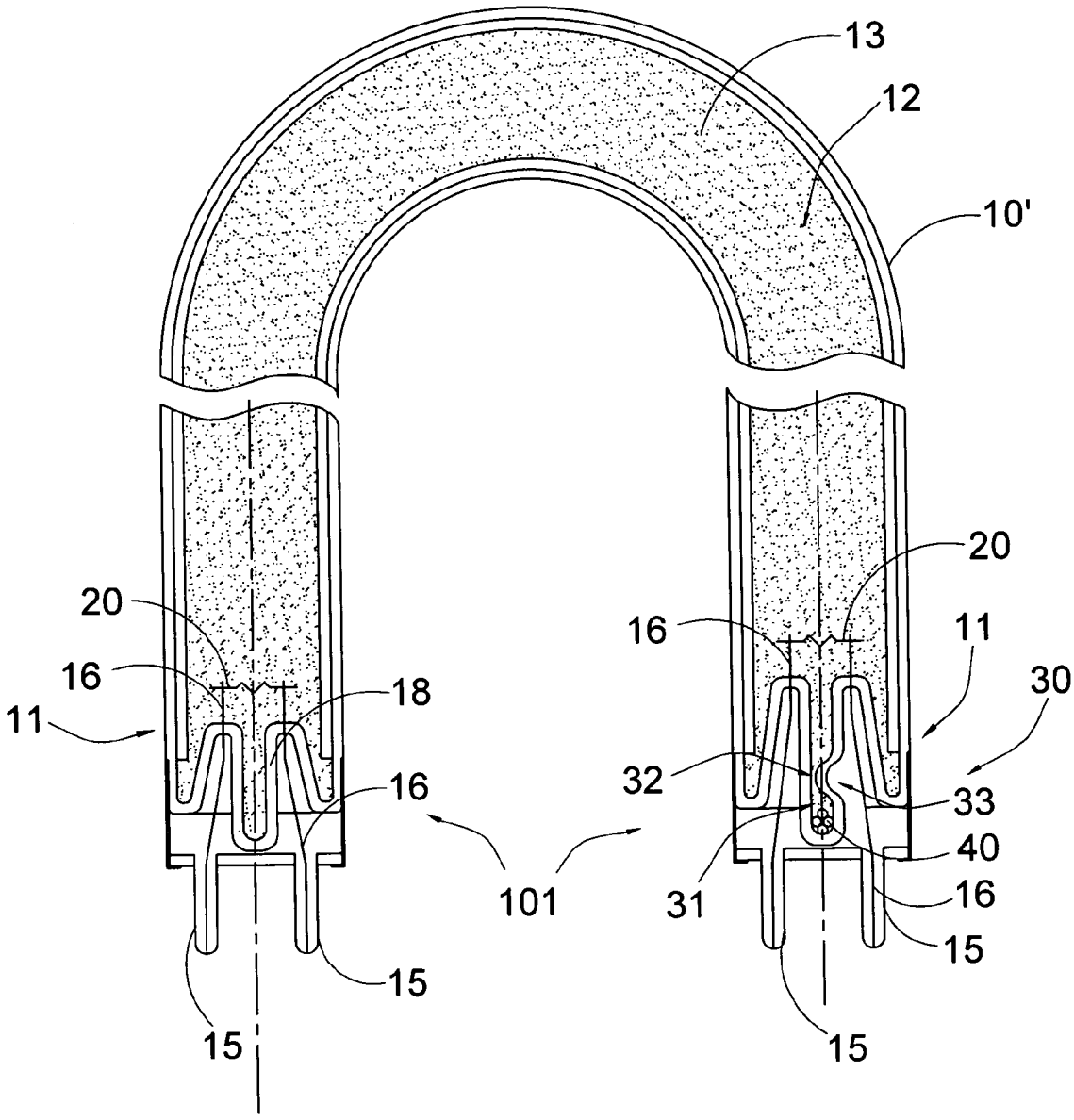
FIG. 5 is an alternative mode of the glass envelope of the fluorescent lamp according to the above preferred embodiment of the present invention, illustrating the glass envelope having a U shaped configuration.

Accordingly, the glass envelope 10 may have an elongated cylindrical shape or any other shape according to the applications. For example, the glass envelope 10 may be U shaped, so that the fluorescent lamp is able to compact sized glass envelope while increasing the light intensity thereof, as shown in FIG. 5.

Figure 3:
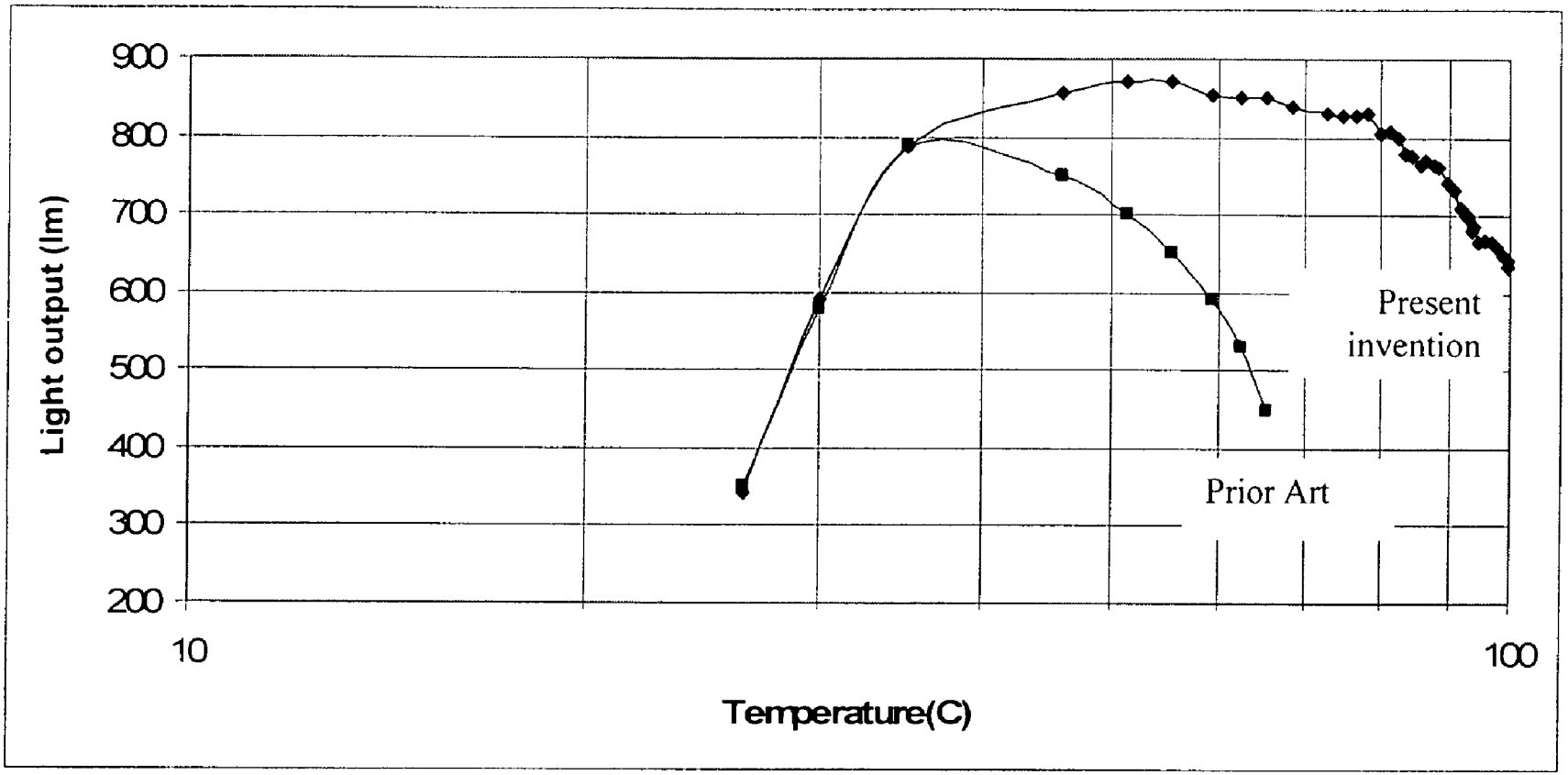
FIG. 3 is a diagram of lamp light output versus ambient temperature according to the above preferred embodiment of the present invention, illustrating the comparison between the prior art and the present invention.

As shown in FIG. 3, two curves in the FIG. 3 show the performance of the traditional fluorescent lamp and the fluorescent lamp of the present invention using similar type of amalgam 40 respectively. The curve of the traditional fluorescent lamp has its best light output at 35° C. only. However, the curve of the fluorescent lamp of the present invention may have even better light output from around a range of 35° C. to 80° C., in which such range can be varied according to the type and preset distance of different amalgam. It proves that the fluorescent lamp of the present invention is able to perform under much wider ambient temperature rang without adding auxiliary amalgam in order to allow the fluorescent lamp being operated under lower or higher temperature according to the applications. Therefore, the cost of manufacturing the fluorescent lamp is significantly minimized.

In order to enhance the efficiency of the fluorescent lamp, Xenon gas is further added into the light cavity 12 to mix with the inert gas 13. Thus, the Xenon gas is able to increase the voltage between the two filaments 20, so as to enhance the efficiency of the high performance fluorescent lamp.

In other words, the voltage of the fluorescent lamp is determined by the type of inert gas, the inert gas pressure, and the mercury vapor pressure. By increasing the inert gas pressure, the lamp voltage can be increased. However, the voltage increase is limited, so that the small amount of Xenon gas added to mix with the inert gas 13 in the present invention can effectively increase the voltage between the two filaments 20.

Figure 4:
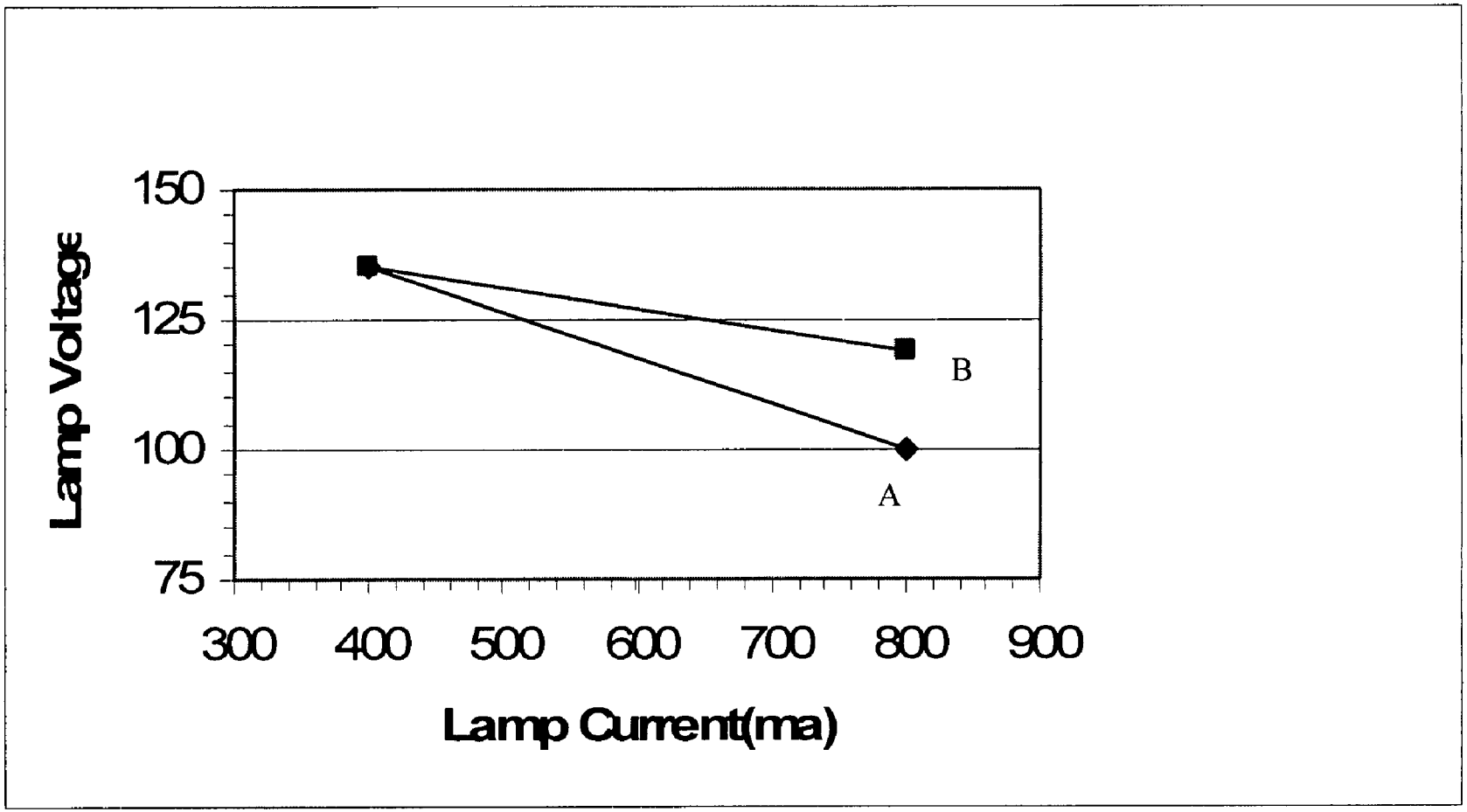
FIG. 4 is a diagram of the lamp current versus lamp voltage according to the above preferred embodiment of the present invention.

As shown in FIG. 4 of the drawings, the curves A and B of FIG. 4 show the "voltage-current" characteristic of the fluorescent lamp of the present invention. As shown in FIG. 4, curve A illustrates that the fluorescent lamp contains the inert gas 13 without xenon gas and operates at 35° C. Accordingly, when the current is increased, the voltage is decreased. Therefore, the power is not increasing as fast as the current increase. The lamp efficiency will be reduced. In order to increase the efficiency of the fluorescent lamp, the slop of the "voltage-current" characteristic has to be changed. The voltage has to be reduced less when the current is increased more.

The voltage of the fluorescent lamp is determined by the type of inert gas 13 and the inert gas pressure and the mercury vapor pressure. By increasing the inert gas pressure, the lamp voltage can be increased. However, it has limited voltage increase. According to the preferred embodiment, a small amount of xenon gas is added to mix with the inert gas 13. The mixed inert gas 13 can increase the lamp voltage dramatically. The curve B in the FIG. 4 shows the "voltage-current" characteristic of the lamp filled with the mixed inert gas 13. Comparing curves A and B, at the same power input, the lamp filled with the mixed inert gas 13, i.e. the curve B, consume less current. Therefore, it has much higher efficiency. With the fixed position of the amalgam 40 of the present invention, the mercury vapor pressure is almost constant in the temperature range.

As will be readily appreciated by one skilled in the art, the commonly applied three color phosphor elements, which are usually in the powder form, are firstly mixed together, and then the liquid glue is added into the mixed powders of the three color phosphor elements. Therefore, the liquid glue with phosphor elements is able to be coated to the inner wall 112 of the glass envelope 100, wherein a dry process is further applied for burning out the glue, so that the phosphor powders of the phosphor elements are being coated on the inner wall 112 of the glass envelope 100 to form the phosphor layer 14 thereon.

Beside the commonly used 3 color phosphor elements mixed, blended and coated on the inner wall as the phosphor layer 14, the present invention further blends another one or two or more color phosphor elements with the common 3 color phosphor elements, in such a manner that the phosphor layer 14 is able to convert the UV light generated via the mercury into the visible light which has the light spectrum from 380 to 700. Therefore, the fluorescent lamp has relatively wider visible light wave range, so as to provide a more ideal light spectrum.

As mentioned above, the coating with blended 3 color phosphors powder normally has high CRI (Color Rending Index). The high CRI means the fluorescent lamp has enough red color light or visible light wavelengths around 700 nm. However, there has almost no emitting light having the wavelength from 380 nm to 420 nm. It is necessary to produce the fluorescent lamp which can emit the light having the wavelength of 420 nm or shorter, due to the wavelength of 420 nm or shorter is still visible to human eyes. In order to make the fluorescent lamp is closer to the ideal light spectrum, more phosphor elements are added. For instance, one phosphor element, which can emit 413 nm light, and another phosphor element, which can emit 390 nm light, are blended into the phosphor layer 14 coated at the inner wall 112 of the glass envelope 100. Therefore, the fluorescent lamp with the extra shorter wavelength coated phosphor elements is able to emit the light having a wider wavelength, for example from 380 nm or shorter to 700 nm or longer. Therefore, the fluorescent lamp of the present invention is able to be made with a desired amplitude of any particular light spectrum according to its specific utility application.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A high performance fluorescent lamp, comprising: an air-tight glass envelope having at least two sealed ends and a light cavity therein, wherein said light cavity is filled with inert gas and coated with a phosphor powder at an inner wall of said light cavity; two electrodes each having a filament being supported at said two sealed ends of said glass envelope respectively, wherein a tubular tail pipe, defining a channel therein, is integrally formed at one of said sealed ends of said glass envelope at a location communicating with said light cavity; and means for retaining an amalgam in said channel at a position forming a predetermined distance between said amalgam and one of said filaments sealed at said corresponding sealed end;

wherein said means is a narrow opening provided at a predetermined position along said channel, wherein said narrow opening has a diameter smaller than that of said channel and said amalgam contained in said channel is blocked by said narrow opening to retain between said narrow opening and a distal end of said tail pipe so as to retain said predetermined distance between said respective filament and said amalgam, thereby by configuring said predetermined distance between said filament and said amalgam, said fluorescent lamp is adapted to be operated under various ambient temperatures or various wattages without substitution of said amalgam.

2. The high performance fluorescent lamp, as recited in claim 1, wherein said tail pipe has a dent portion formed thereat to form said narrow opening such that said amalgam is contained at said predetermined distance between said dent portion and said distal end of said tail pipe.

3. The high performance fluorescent lamp, as recited in claim 2, wherein said dent portion is formed at said tail pipe at a position close to said respective filament.

4. The high performance fluorescent lamp, as recited in claim 2, wherein said tail pipe comprises one or more glass beads disposed within said communicating channel to further precisely retain said amalgam at said predetermined position.

5. The high performance fluorescent lamp, as recited in claim 1, wherein said tail pipe comprises one or more glass beads disposed within said communicating channel to further precisely retain said amalgam at said predetermined position.

6. The high performance fluorescent lamp, as recited in claim 5, wherein said amalgam is located within said channel at a position between said narrow opening and said glass beads.

7. The high performance fluorescent lamp, as recited in claim 5, wherein said amalgam is located within said channel at a position between said glass beads.

8. The high performance fluorescent lamp, as recited in claim 5, wherein said amalgam is received in said tail pipe during a formation of said tail pipe to retain said amalgam at said predetermined position.

9. The high performance fluorescent lamp, as recited in claim 5, wherein said inert gas filled within said light cavity comprises Xenon gas.

10. The high performance fluorescent lamp, as recited in claim 9, wherein each of said electrode further comprises contact terminals and support wires provided at each of said sealed ends for electrically connecting said contact terminals with said corresponding filament, thereby a power source is electrically connected to said contact terminals for supplying power to said filament, wherein said filament is extended for shortening or extending said predetermined distance between said filament and said amalgam.

11. The high performance fluorescent lamp, as recited in claim 1, further comprising an insulation material encircling with said tail pipe.

12. The high performance fluorescent lamp, as recited in claim 1, wherein said tail pipe comprises one or more glass beads fitting in said channel to form said narrow opening at a gap between said glass beads and an inner wall of glass envelope so as to retain said amalgam at said predetermined position.

13. The high performance fluorescent lamp, as recited in claim 12, wherein each of said glass beads is slightly larger than a size of said tail pipe opening such that when said glass beads fit in said channel, said amalgam is blocked by said glass beads to limit a movement of said amalgam within said channel.

14. The high performance fluorescent lamp, as recited in claim 12, wherein said amalgam is received in said tail pipe during a formation of said tail pipe to retain said amalgam at said predetermined position.

15. The high performance fluorescent lamp, as recited in claim 12, wherein said inert gas filled within said light cavity comprises Xenon gas.

16. The high performance fluorescent lamp, as recited in claim 15, wherein said phosphor layer converts a generated UV light within said light cavity of said glass envelope into a light having a light spectrum range 420 nm or shorter and 700 nm or longer.

17. The high performance fluorescent lamp, as recited in claim 1, wherein said amalgam is received in said tail pipe during a formation of said tail pipe to retain said amalgam at said predetermined position.

18. The high performance fluorescent lamp, as recited in claim 1, wherein said inert gas filled within said light cavity comprises Xenon gas.

19. The high performance fluorescent lamp, as recited in claim 18, wherein said phosphor layer converts a generated UV light within said light cavity of said glass envelope into a light having a light spectrum range 420 nm or shorter and 700 nm or longer.

20. The high performance fluorescent lamp, as recited in claim 18, wherein each of said electrode further comprises contact terminals and support wires provided at each of said sealed ends for electrically connecting said contact terminals with said corresponding filament, thereby a power source is electrically connected to said contact terminals for supplying power to said filament, wherein said filament is extended for shortening or extending said predetermined distance between said filament and said amalgam.

21. The high performance fluorescent lamp, as recited in claim 20, wherein a sealing base is provided to enclose an indented cavity formed between said sealed end and said sealing base, so as to support and hold said support wires at a position to electrically contacting with said corresponding filament.

22. The high performance fluorescent lamp, as recited in claim 21, wherein said sealing base comprises a surrounding cover circling an outer peripheral surface of said glass envelope adjacent to said sealed end, and an end cover engaging with said surrounding cover to enclose said indented cavity within said surrounding cover and said end cover, wherein said end cover is made of an insulation material.

23. The high performance fluorescent lamp, as recited in claim 21, wherein a depth of said indented cavity is larger than a length of said channel.

* * * * *